US011738571B2

(12) United States Patent
Kanegae et al.

(10) Patent No.: US 11,738,571 B2
(45) Date of Patent: Aug. 29, 2023

(54) LIQUID DISCHARGE APPARATUS

(71) Applicant: Seiko Epson Corporation, Tokyo (JP)

(72) Inventors: Takahiro Kanegae, Shiojiri (JP); Nobuaki Ito, Shiojiri (JP); Hiroyuki Hagiwara, Matsumoto (JP)

(73) Assignee: SEIKO EPSON CORPORATION

( * ) Notice: Subject to any disclaimer, the term of this patent is extended or adjusted under 35 U.S.C. 154(b) by 64 days.

(21) Appl. No.: 17/643,862

(22) Filed: Dec. 13, 2021

(65) Prior Publication Data

US 2022/0184972 A1 Jun. 16, 2022

(30) Foreign Application Priority Data

Dec. 14, 2020 (JP) ..... 2020-206763

(51) Int. Cl.
*B41J 3/54* (2006.01)
*B41J 2/14* (2006.01)

(52) U.S. Cl.
CPC ..... *B41J 3/543* (2013.01); *B41J 2/14201* (2013.01)

(58) Field of Classification Search
CPC ..... B41J 3/543; B41J 2/14201; B41J 2002/14362; B41J 2202/19; B41J 2202/20; B41J 2/155
See application file for complete search history.

(56) References Cited

U.S. PATENT DOCUMENTS

2012/0038709 A1* 2/2012 Owaki ..... B41J 2/17553 347/40
2020/0101733 A1 4/2020 Hagiwara et al.

FOREIGN PATENT DOCUMENTS

JP 2020-049874 A 4/2020

OTHER PUBLICATIONS

IP.com search (Year: 2023).*

* cited by examiner

*Primary Examiner* — Lisa Solomon
(74) *Attorney, Agent, or Firm* — Harness, Dickey & Pierce, P.L.C.

(57) ABSTRACT a≥b≥0, p≥1, q≥1, where a is a number of pairs each consisting of two adjacent first head units, b is a number of pairs each consisting of two adjacent second head units, p is a number of first head units, and q is a number of second head units.

16 Claims, 6 Drawing Sheets

LIQUID DISCHARGE APPARATUS

The present application is based on, and claims priority from JP Application Serial Number 2020-206763, filed Dec. 14, 2020, the disclosure of which is hereby incorporated by reference herein in its entirety.

BACKGROUND

1. Technical Field

The present disclosure relates to a liquid discharge apparatus.

2. Related Art

As represented by an ink jet printer, a liquid discharge apparatus that discharges liquid, such as ink, as droplets is known from the past.

For example, the apparatus described in JP-A-2020-49874 has a head module having a configuration in which a plurality of head units are supported by a supporting body. Each of the plurality of head units has a first section, a second section and a third section which have a width less than the width of the first section. Here, the first section is provided between the second section and the third section, and each head unit is provided with four circulation heads so that a plurality of nozzles are arranged over these sections.

In general, a desirable length of the head module along the arrangement direction of nozzles varies depending on the model of the printer. However, as described in JP-A-2020-49874, when multiple head units having the same configuration are solely combined and used, a head module with a length of approximately an integral multiple of the length of each head unit is only obtained. Therefore, with the configuration described in JP-A-2020-49874, different head units are needed for each of models, thus there is a problem in that the versatility of the head unit is low.

SUMMARY

In order to solve the above-mentioned problem, the liquid discharge apparatus according to a preferred embodiment of the present disclosure includes: a plurality of head units that are arranged in a row in a first direction and that discharge liquid; and a controller that controls an operation of discharge of liquid in the plurality of head units. The plurality of head units includes: one or more first head units and one or more second head units different from any of the one or more first head units, each of the one or more first head units including: a first section, a second section that is at a position different from a position of the first section in a first direction and that has a width less than a width of the first section in a second direction crossing the first direction, a third section that is at a position different from the position of the first section in the first direction and that has a width less than the width of the first section in the second direction, a first head which is provided across the first section and the second section and in which a plurality of nozzles are arranged, a second head which is provided only in the first section and in which a plurality of nozzles are arranged, a third head which is provided only in the first section and in which a plurality of nozzles are arranged, and a fourth head which is provided across the first section and the third section and in which a plurality of nozzles are arranged, each of the one or more second head units including: a fourth section, a fifth section that is at a position different from a position of the fourth section in the first direction and that has a width less than a width of the fourth section in the second direction, a sixth section that is at a position different from the position of the fourth section in the first direction and the has a width less than the width of the fourth section in the second direction, a fifth head which is provided across the fourth section and the fifth section and in which a plurality of nozzles are arranged, and a sixth head which is provided across the fourth section and the sixth section and in which a plurality of nozzles are arranged, $a \geq b \geq 0$, $p \geq 1$, $q \geq 1$, where a is a number of pairs each consisting of two adjacent first head units among the one or more first head units, b is a number of pairs each consisting of two adjacent second head units among the one or more second head units, p is a number of first head units in the one or more first head units, and q is a number of second head units in the one or more second head units.

DESCRIPTION OF EXEMPLARY EMBODIMENTS

Figure 1:
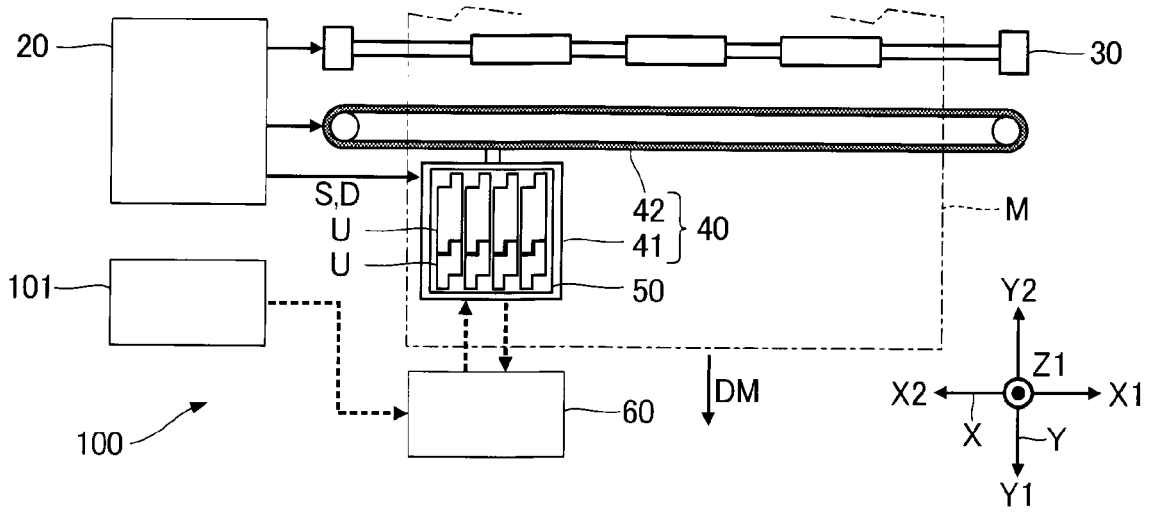
FIG. 1 is a schematic view illustrating a configuration example of a liquid discharge apparatus according to a first embodiment.

Hereinafter a preferred embodiment according to the present disclosure will be described with reference to the accompanying drawings. Note that dimensions or scales of the components in the drawings are different from actual ones as appropriate, and part of the components is schematically illustrated in order to facilitate the understanding. In the following description, the scope of the present disclosure is not particularly limited to the embodiments below unless otherwise is stated.

Note that the X-axis, the Y-axis and the Z-axis which intersect each other are used as appropriate to provide the following description. One direction along the X-axis is referred to as X1 direction, and the direction opposite to the X1 direction is referred to as X2 direction. Similarly, directions opposite to each other along the Y-axis are referred to as Y1 direction and Y2 direction. In addition, directions opposite to each other along the Z-axis are referred to as Z1 direction and Z2 direction. The Y1 direction or the Y2 direction is an example of "first direction". The X1 direction or the X2 direction is an example of "second direction". In addition, viewing in a direction along the Z-axis is called "plan view".

Here, typically, the Z-axis is a vertical axis, and the Z2 direction corresponds to a downward direction in the vertical direction. However, the Z-axis may not be a vertical axis. The X-axis, the Y-axis and the Z-axis typically intersect each other perpendicularly, however without being limited to this, for example, may intersect at an angle in a range of 80° or more and 100° or less.

1. First Embodiment

1-1 Schematic Configuration of Liquid Discharge Apparatus

FIG. 1 is a schematic view illustrating a configuration example of a liquid discharge apparatus 100 according to a first embodiment. The liquid discharge apparatus 100 is an ink jet printing apparatus that discharges ink to a medium M as droplets, the ink being an example of liquid. The medium M is an example of a "recording medium" and is typically printing paper. Note that the medium M is not limited to printing paper and, may be, for example, a printing object of any material, such as a resin film or fabric.

As illustrated in FIG. 1, a liquid container 101 storing ink is mounted to the liquid discharge apparatus 100. Specific embodiments of the liquid container 101 include, for example, a cartridge detachable from the liquid discharge apparatus 100, a bag-shaped ink pack formed of a flexible film, and an ink tank in which ink can be refilled.

The liquid container 101 of the present embodiment has a plurality of containers (not illustrated) which store ink of different types. The ink stored in the plurality of containers is not particularly limited, and may be, for example, cyan ink, magenta ink, yellow ink, black ink, clear ink, white ink and treatment liquid, and a combination of two or more of these types is used as the ink.

Here, the composition of each of cyan ink, magenta ink, yellow ink and black ink is not particularly limited, and may be, for example, a water-based ink in which a color material, such as dye or pigment, is dissolved in a water-based solvent, a solvent-based ink in which a color material is dissolved in an organic solvent, or an ultraviolet curable ink. The clear ink is an ink which contains no color material, and is for improving the scratch resistance of a surface printed with a color material by overcoating the surface with the ink, and/or reduces color shift due to diffuse reflection by decreasing the irregularities of pigment components. The white ink contains a white pigment or the like, and is for reducing non-white property due to dirt of the medium M. The treatment liquid is an ink having reactivity with the components contained in the color material ink, and for increasing the fixing property of the color material ink by bringing the treatment liquid into contact with the color material ink on the medium M.

As illustrated in FIG. 1, the liquid discharge apparatus 100 includes a control unit 20, a transport mechanism 30, a movement mechanism 40, a head module 50, and a circulation mechanism 60.

The control unit 20 includes, for example, a processing circuit such as a central processing unit (CPU) or a field programmable gate array (FPGA) and a storage circuit such as a semiconductor memory, and controls the operation of each component of the liquid discharge apparatus 100. Here, the control unit 20 is an example of a "controller", and controls the operation of discharge of ink performed by the head module 50.

The transport mechanism 30 transports the medium M under the control of the control unit 20 in a transport direction DM which is the Y1 direction. The movement mechanism 40 causes the head module 50 to reciprocate in the X1 direction and the X2 direction under the control of the control unit 20. In the example illustrated in FIG. 1, the movement mechanism 40 has a substantially box-shaped transport body 41 referred to as a carriage, which houses the head module 50; and a transport belt 42 to which the transport body 41 is fixed. Note that in addition to the head module 50, the above-mentioned liquid container 101 may be mounted on the transport body 41.

The head module 50 discharges ink through each of a plurality of nozzles to the medium M in the Z2 direction under the control of the control unit 20, the ink being supplied from the liquid container 101 through the circulation mechanism 60. The discharge is performed concurrently with transport of the medium M by the transport mechanism 30 and reciprocating motion of the head module 50 caused by the movement mechanism 40, thus an image made of ink is formed on the surface of the medium M. Note that the head module 50 has a plurality of head unit U as described below.

In the example illustrated in FIG. 1, the liquid container 101 is coupled to the head module 50 via the circulation mechanism 60. The circulation mechanism 60 is a mechanism that supplies ink to the head module 50, and collects the ink discharged from the head module 50 for resupply the ink to the head module 50. Although illustration is not provided, the circulation mechanism 60 has, for example, a subtank that stores ink, a supply flow path for supplying ink to the head module 50 from the subtank, a collection flow path for collecting ink from the head module 50 into the subtank, and a pump for causing ink to flow in these flow paths. These units are provided for each type of the ink stored in the liquid container 101 described above. The operation of the circulation mechanism 60 mentioned above can reduce increase in the viscosity of ink, and staying of air bubbles in the ink.

Figure 2:
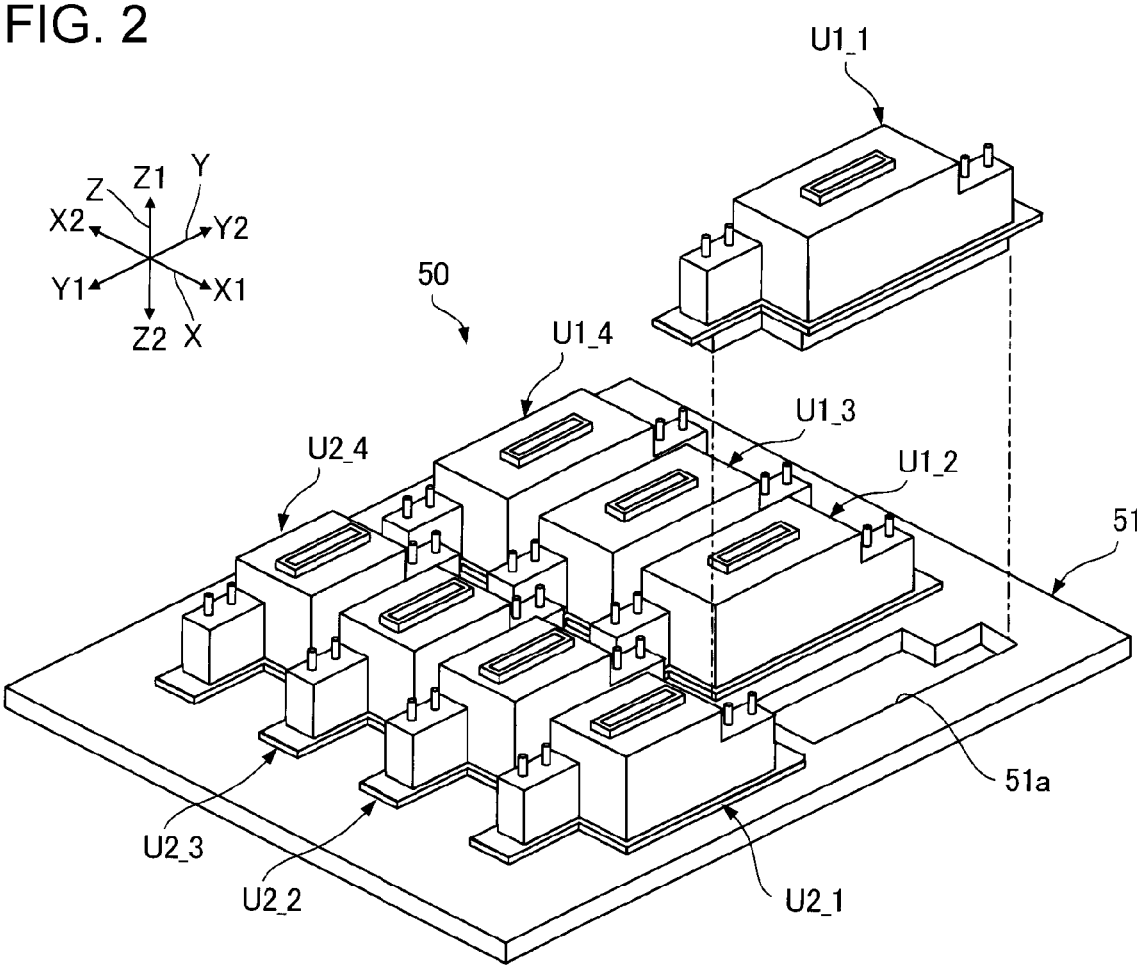
FIG. 2 is a perspective view of a head module in the first embodiment.

FIG. 2 is a perspective view of the head module 50 in the first embodiment. As illustrated in FIG. 2, the head module 50 has a supporting body 51, first head units U1_1 to U1_4, and second head units U2_1 to U2_4. Each of the first head units U1_1 to U1_4 and each of the second head units U2_1 to U2_4 have different lengths along the Y-axis. Thus, the versatility of the head unit U can be increased, as compared with the configuration using only the plurality of head units having the same length. The configuration of these head units U will be described in detail later.

Note that in the following, without distinguishing between the first head units U1_1 to U1_4, each of these units may be referred to as a first head unit U1. Similarly, without distinguishing between the second head units U2_1 to U2_4, each of these units may be referred to as a second head unit U2. In addition, without distinguishing between the first head units U1_1 to U1_4 and the second head units U2_1 to U2_4, each of these units may be referred to as a head unit U.

The supporting body 51 is a plate-like member that supports a plurality of head units U. The supporting body 51 is provided with a plurality of mounting holes 51*a*. Each head unit U is fixed to the supporting body 51 by a screw or the like with the head unit U inserted in a mounting hole 51*a*. The plurality of head units U are arranged in a matrix form along the X-axis and the Y-axis. More specifically, the first head units U1_1 to U1_4 are arranged in this order in the X2 direction, and the second head units U2_1 to U2_4 are arranged in this order in the X2 direction. Here, the second head unit U2_1 is arranged at a position away from the first head unit U1_1 in the Y1 direction. The second head unit U2_2 is arranged at a position away from the first head unit U1_2 in the Y1 direction. The second head unit U2_3 is arranged at a position away from the first head unit U1_3 in the Y1 direction. The second head unit U2_4 is arranged at a position away from the first head unit U1_4 in the Y1 direction.

Note that the head module 50 just needs to have one or more first head units U1 and one or more second head units U2, and the number of head units U included in the head module 50 is not limited to the example illustrated in FIG. 2. The head module 50 just needs to have the first head unit U1 and the second head unit U2 which are adjacent to each other, and the arrangement of a plurality of head units U is not limited to the example illustrated in FIG. 2. In the example illustrated in FIG. 2, a mounting hole 51*a* is provided in the supporting body 51 for each head unit U; however, a mounting hole 51*a* may be provided for each set of two or more head units U.

1-2. Head Unit U

Figure 3:
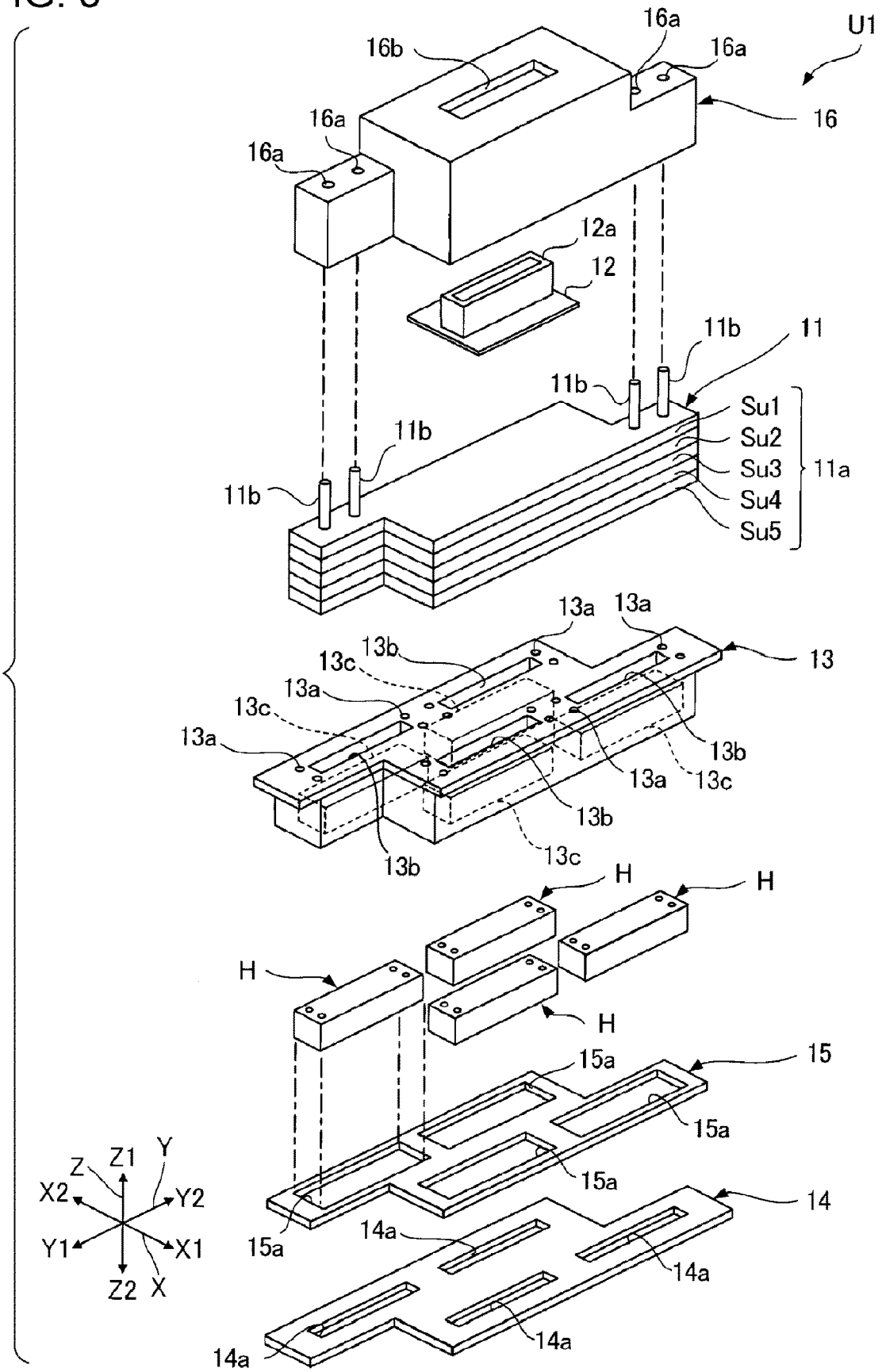
FIG. 3 is an exploded perspective view of a head unit.

FIG. 3 is an exploded perspective view of the first head unit U1. Hereinafter the configuration of the head unit U will be described by way of example of the first head unit U1. Since the second head unit U2 is the same as the first head unit U1 except that the number of included heads H is different, and the configuration differs accordingly, a description of the same matters is omitted.

As illustrated in FIG. 3, the first head unit U1 has a flow path structure 11, a wiring substrate 12, a holder 13, four heads H, a fixing plate 14, a reinforcing plate 15, and a cover 16. These are arranged so that the cover 16, the wiring substrate 12, the flow path structure 11, the holder 13, the four heads H, the reinforcing plate 15, and the fixing plate 14 are aligned in this order in the Z2 direction. The components of the first head unit U1 will be described sequentially below.

The flow path structure 11 is a structure that internally includes a flow path for supplying the ink stored in the above-described circulation mechanism 60 to the four heads H. The flow path structure 11 has a flow path member 11*a* and four coupling tubes 11*b*.

The flow path member 11*a* is provided with two supply flow paths (not illustrated) for respectively supplying two types of ink to the four heads H, and two discharge flow paths (not illustrated) for respectively discharging the two types of ink from the four heads H. In the following, one of the two types of ink may be referred to as a first ink, and the other may be referred to as a second ink.

The flow path member 11*a* has a plurality of substrates Su1 to Su5, and these layers are stacked in this order in the Z2 direction. Each of the substrates Su1 to Su5 is made of, for example, a resin material, and is formed by injection molding. In addition, the plurality of substrates Su1 to Su5 are bonded to each other by an adhesive agent, for example. Note that the number and the thickness of the substrates included in the flow path member 11*a* are optional and not limited to those in the example illustrated in FIG. 3.

Each of the four coupling tubes 11*b* is a tube which projects from the surface, oriented in the Z1 direction, of the flow path member 11*a*. The four coupling tubes 11*b* correspond to four flow paths consisting of the above-mentioned two supply flow paths and two discharge flow paths, and are coupled to the corresponding flow paths.

The wiring substrate 12 is a mounting component for electrically coupling the first head unit U1 to the control unit 20. The wiring substrate 12 is comprised of, for example, a flexible wiring substrate or a rigid wiring substrate. The wiring substrate 12 is arranged on the flow path structure 11, and the surface, oriented in the Z2 direction, of the wiring substrate 12 is opposed to the flow path structure 11. On the other hand, a connector 12*a* is mounted on the surface, oriented in the Z1 direction, of the wiring substrate 12. The connector 12*a* is a coupling component to electrically couple the first head unit U1 and the control unit 20. Wiring (not illustrated), which is to be coupled to the four heads H, is coupled to the wiring substrate 12. The wiring is formed by a combination of a flexible wiring substrate and a rigid wiring substrate, for example. Note that the wiring may be integrally formed with the wiring substrate 12.

The holder 13 is a structure that houses and supports the four heads H. The holder 13 is made of a resin material or a metal material, for example. The holder 13 is provided with a plurality of ink holes 13*a*, a plurality of wire holes 13*b*, and a plurality of recessed portions 13*c*. Each of the plurality of ink holes 13*a* is a flow path for flowing ink between a head H and the flow path structure 11. Each of the plurality of wire holes 13*b* is a hole into which a wire (not illustrated) is inserted, the wire coupling a head H and the wiring substrate 12. Each of the plurality of recessed portions 13*c* is a space which is open in the Z2 direction, and in which a head H is arranged.

Each head H discharges ink. Although illustration is omitted in FIG. 3, specifically, each head H has a plurality of nozzles for discharging the first ink and a plurality of nozzles for discharging the second ink. The configuration of the head H will be described in detail with reference to FIG. 4 mentioned later.

The fixing plate 14 is a plate member for fixing the four heads H to the holder 13. Specifically, the fixing plate 14 is placed with the four heads H interposed between the fixing plate 14 and the holder 13, and fixed to the holder 13 by an adhesive agent. The fixing plate 14 is made of a metal material, for example. The fixing plate 14 is provided with a plurality of openings 14*a* for exposing the nozzles of the four heads H. In the example illustrated in FIG. 3, the plurality of openings 14*a* are individually provided for each of the heads H. Note that an opening 14*a* may also be shared by two or more heads H.

The reinforcing plate 15 is a plate-like member arranged between the holder 13 and the fixing plate 14 to reinforce the fixing plate 14. The reinforcing plate 15 is overlapped and arranged on the fixing plate 14, and fixed to the fixing plate 14 by an adhesive agent. The reinforcing plate 15 is provided with a plurality of openings 15*a* in which the four heads H are arranged. The reinforcing plate 15 is made of a metal material, for example.

The cover 16 is a box-like member that houses the flow path member 11*a* of the flow path structure 11, and the wiring substrate 12. The cover 16 is made of a resin material, for example. The cover 16 is provided with four through-holes 16*a* and an opening 16*b*. The four through-holes 16*a* correspond to the four coupling tubes 11*b* of the flow path structure 11, and in each through-hole 16*a*, a corresponding coupling tube 11*b* is inserted. The connector 12*a* is inserted through the opening 16*b* from the inside to the outside of the cover 16.

1-3. Head H

Figure 4:
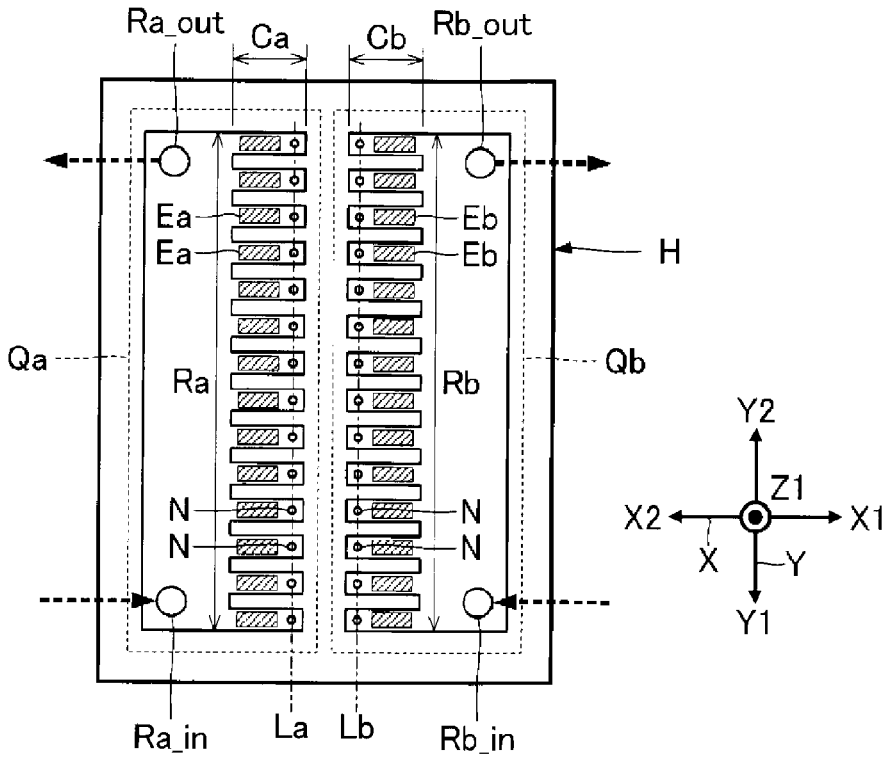
FIG. 4 is a schematic view illustrating a configuration example of a head.

FIG. 4 is a schematic view illustrating a configuration example of a head H. In FIG. 4, the internal structure of the head H as viewed in the Z2 direction is schematically illustrated. As illustrated in FIG. 4, the head H is provided with a plurality of nozzles N for discharging ink. The plurality of nozzles N are divided into a nozzle array La and a nozzle array Lb. Each of the nozzle array La and the nozzle array Lb is a set of a plurality of nozzles N arranged along the Y-axis. The nozzle array La and the nozzle array Lb are arranged with a space therebetween in the direction of the X-axis. In the following, subscript a is added to the symbol for each component related to the nozzle array La, and subscript b is added to the symbol of each component related to the nozzle array Lb.

The head H has a liquid discharge section Qa including the nozzle array La, and a liquid discharge section Qb including the nozzle array Lb. The first ink is supplied to the liquid discharge section Qa from the above-described circulation mechanism 60. In contrast, the second ink is supplied to the liquid discharge section Qb from the circulation mechanism 60.

The liquid discharge section Qa has a liquid storage chamber Ra, a plurality of pressure chambers Ca, and a plurality of drive elements Ea. The liquid storage chamber Ra is a common liquid chamber which is continuous over a plurality of nozzles N of the nozzle array La. Each of the pressure chamber Ca and the drive elements Ea is provided for each of the nozzles N of the nozzle array La. The pressure chamber Ca is a space communicating with the nozzles N. Each of the plurality of pressure chambers Ca is filled with the first ink supplied from the liquid storage chamber Ra. Each drive element Ea changes the pressure of the first ink in the pressure chamber Ca. The drive element Ea is a piezoelectric device that changes the volume of the pressure chamber Ca, for example, by deforming the wall surface of the pressure chamber Ca, or a heating element that generates air bubbles in the pressure chamber Ca by heating the first ink in the pressure chamber Ca. The drive element Ea changes the pressure of the first ink in the pressure chamber Ca, thereby discharging the first ink in the pressure chamber Ca through the nozzles N.

Similar to the liquid discharge section Qa, the liquid discharge section Qb has a liquid storage chamber Rb, a plurality of pressure chambers Cb, and a plurality of drive elements Eb. The liquid storage chamber Rb is a common liquid chamber which is continuous over a plurality of nozzles N of the nozzle array Lb. Each of the pressure chamber Cb and the drive elements Eb is provided for each of the nozzles N of the nozzle array Lb. Each of the plurality of pressure chambers Cb is filled with the second ink supplied from the liquid storage chamber Rb. The drive element Eb is, for example, a piezoelectric device or a heating element described above. The drive element Eb changes the pressure of the second ink in the pressure chamber Cb, thereby discharging the second ink in the pressure chamber Cb through the nozzles N.

As illustrated in FIG. 4, the head H is provided with an inlet port Ra_in, an outlet port Ra_out, an inlet port Rb_in, and an outlet port Rb_out. Each of the inlet port Ra_in and the outlet port Ra_out communicates with the liquid storage chamber Ra. Each of the inlet port Rb_in and the outlet port Rb_out communicates with the liquid storage chamber Rb.

In the head H described above, the first ink which is stored in the liquid storage chamber Ra without being discharged through each nozzle N of the nozzle array La is circulated through the outlet port Ra_out, a circulation flow path for the first ink in the holder 13, a discharge flow path for the first ink in the flow path structure 11, a subtank for the first ink in the circulation mechanism 60, a supply flow path for the first ink in the flow path structure 11, a supply flow path for the first ink in the holder 13, the inlet port Ra_in, and the liquid storage chamber Ra in this order. Similarly, the second ink which is stored in the liquid storage chamber Rb without being discharged through each nozzle N of the nozzle array Lb is circulated through the outlet port Rb_out, a circulation flow path for the second ink in the holder 13, a discharge flow path for the second ink in the flow path structure 11, a subtank for the second ink in the circulation mechanism 60, a supply flow path for the second ink in the flow path structure 11, a supply flow path for the second ink in the holder 13, the inlet port Rb_in, and the liquid storage chamber Rb in this order.

1-4. Arrangement of Heads in First Head Unit

Figure 5:
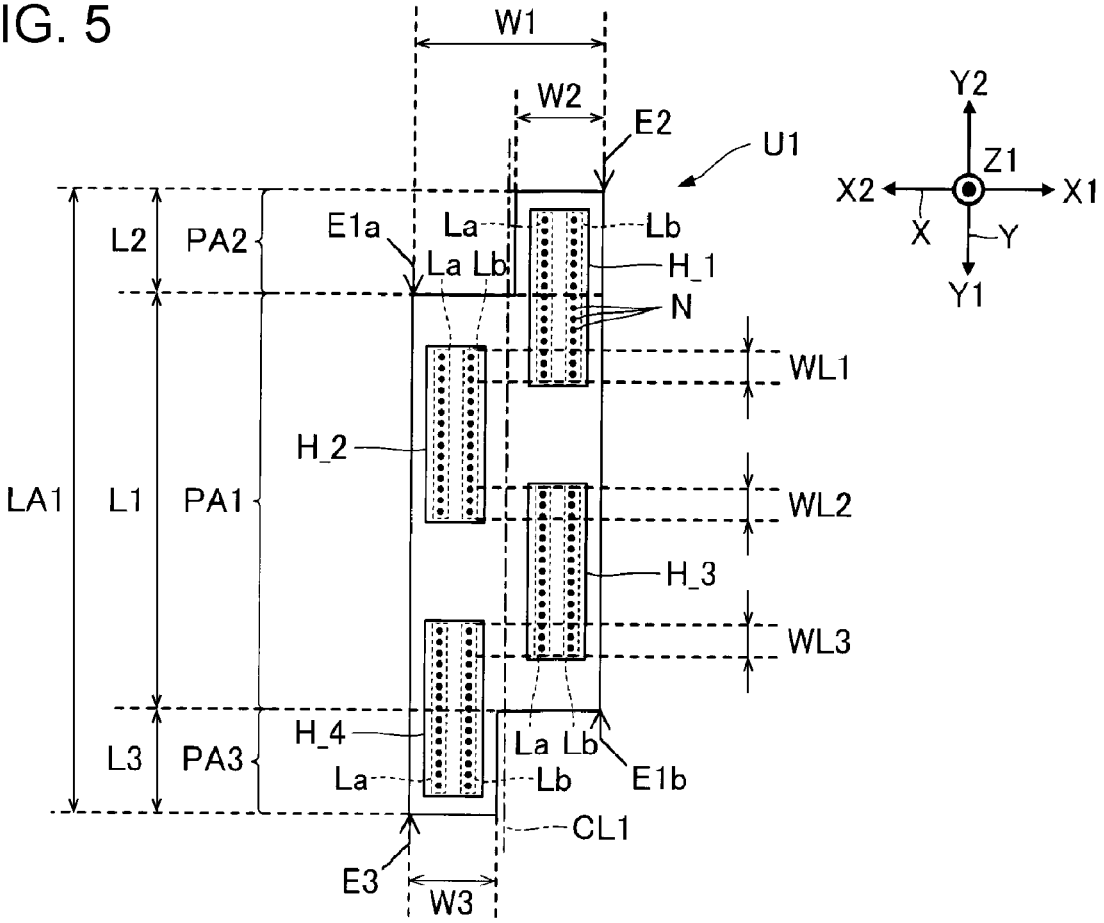
FIG. 5 is a plan view of a first head unit.

FIG. 5 is a plan view of the first head unit U1. In FIG. 5, the arrangement of the heads H in the first head unit U1 as viewed in the Z2 direction is schematically illustrated. In FIG. 5, four heads H included in the first head unit U1 are illustrated as a first head H_1, a second head H_2, a third head H_3 and a fourth head H_4.

As illustrated in FIG. 5, the first head unit U1 has a first section PA1, a second section PA2, a third section PA3, the first head H_1, the second head H_2, the third head H_3 and the fourth head H_4. The outline of the first head unit U1 as viewed in the Z2 direction is formed by the first section PA1, the second section PA2, and the third section PA3.

The first section PA1 is located between the second section PA2 and the third section PA3. Here, the positions of the first section PA1, the second section PA2 and the third section PA3 in the Y1 direction or the Y2 direction are different each other. Specifically, the second section PA2 is located away from the first section PA1 in the Y2 direction, and the third section PA3 is located away from the first section PA1 in the Y1 direction. In other words, the second section PA2 projects in the Y2 direction from the end of the first section PA1 in the Y2 direction, and the third section PA3 projects in the Y1 direction from the end of the first section PA1 in the Y1 direction.

Here, the second section PA2 is located away from center line CL1 in the X1 direction, and the third section PA3 is located away from the center line CL1 in the X2 direction. In this manner, the second section PA2 and the third section PA3 are located on the opposite sides with respect to the center line CL1. Note that the center line CL1 is a virtual line segment which is parallel to the Y-axis and passes through the center of the first section PA1.

As illustrated in FIG. 5, width W2 of the second section PA2 along the X-axis is less than width W1 of the first section PA1 along the X-axis. Similarly, width W3 of the third section PA3 along the X-axis is less than the width W1 of the first section PA1 along the X-axis. In the example illustrated in FIG. 5, the width W2 and the width W3 are equal to each other. Note that the width W2 and the width W3 may be different from each other. However, when the width W2 and the width W3 are equal to each other, symmetry of the shape of the first head unit U1 is enhanced, thus the flexibility of arrangement of the first head unit U1 can be increased. Thus, this case has an advantage that the versatility of the first head unit U1 is increased.

Length L2 of the second section PA2 along the Y-axis is shorter than length L1 of the first section PA1 along the Y-axis. Similarly, length L3 of the third section PA3 along the Y-axis is shorter than the length L1 of the first section PA1 along the Y-axis. In the example illustrated in FIG. 5, the length L2 and the length L3 are equal to each other. Note that the length L2 and the length L3 may be different from each other; however, when the length L2 and the length L3 are equal to each other, symmetry of the shape of the first head unit U1 is enhanced, thus the flexibility of arrangement of the first head unit U1 can be increased.

The positions of end E1*b* of the first section PA1 in the X1 direction and end E2 of the second section PA2 in the X1 direction are equal to each other in the X1 direction or the X2 direction. The end E1*b* and the end E2 form a continuous plane as an end face of the first head unit U1 in the X1 direction. Similarly, the positions of end E1*a* of the first section PA1 in the X2 direction and end E3 of the third section PA3 in the X2 direction are equal to each other in the X1 direction or the X2 direction. The end E1*a* and the end E3 form a continuous plane as an end face of the first head unit U1 in the X2 direction. Note that these end faces may be provided with recessed portions or projecting portions as needed. In addition, a step may be provided between the end E1*b* and the end E2 or between the end E1*a* and the end E3.

The first head H_1 is provided across the first section PA1 and the second section PA2. Specifically, the first head H_1 has a portion provided in the first section PA1 and a portion provided in the second section PA2, and these portions are continuously connected.

Each of the second head H_2 and the third head H_3 is provided only in the first section PA1. In other words, each of the second head H_2 and the third head H_3 is provided in the first section PA1 without having a portion provided in the second section PA2 and the third section PA3.

Here, the second head H_2 is located away from the third head H_3 in the Y2 direction. In other words, the third head H_3 is located away from the second head H_2 in the Y1 direction. In addition, the second head H_2 is located away from the third head H_3 in the X2 direction. In other words, the third head H_3 is located away from the second head H_2 in the X1 direction. In the example illustrated in FIG. 5, the second head H_2 and the third head H_3 are located on the opposite sides with respect to the center line CL1.

The fourth head H_4 is provided across the first section PA1 and the third section PA3. Specifically, the fourth head H_4 has a portion provided in the first section PA1 and a portion provided in the third section PA3, and these portions are continuously connected.

Of the first head H_1, the second head H_2, the third head H_3 and the fourth head H_4 mentioned above, the first head H_1 and the third head H_3 are arranged in a row along the Y-axis, and the second head H_2 and the fourth head H_4 are arranged in a row along the Y-axis.

Here, the first head H_1 and the second head H_2 have portions overlapping each other cross-sectionally along the Y-axis by width WL1. The second head H_2 and the third head H_3 have portions overlapping each other cross-sectionally along the Y-axis by width WL2. The third head H_3 and the fourth head H_4 have portions overlapping each other cross-sectionally along the Y-axis by width WL3. Since such width WL1, width WL2 and width WL3 are provided, a seam between images produced by the first head H_1, the second head H_2, the third head H_3 and the fourth head H_4 can be made less noticeable.

The width WL1, the width WL2 and the width WL3 may be different from each other. However, from the view point of simplifying a process of making the seam less noticeable, the widths may be equal to each other. Specific width WL1, width WL2 and width WL3 are not particularly limited, however, each width has a length from 40 times to 70 times the pitch between the nozzles N of the nozzle array La or the nozzle array Lb, for example.

1-5. Arrangement of Heads in Second Head Unit

Figure 6:
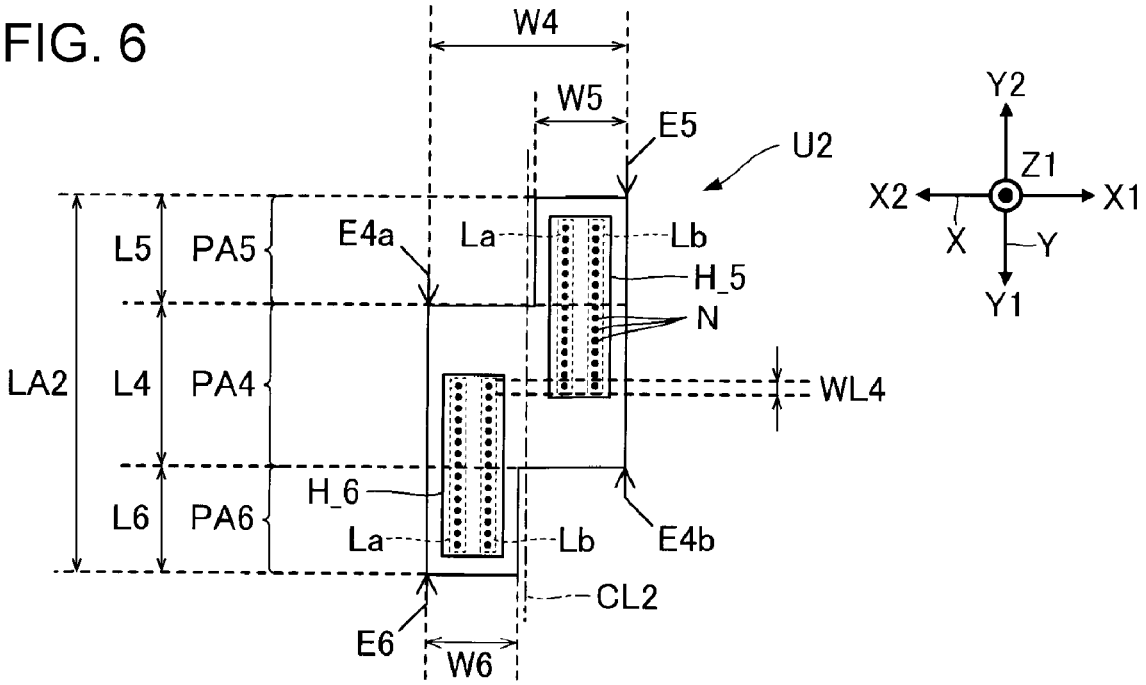
FIG. 6 is a plan view of a second head unit.

FIG. 6 is a plan view of the second head unit U2. In FIG. 6, the arrangement of the heads H in the second head unit U2 as viewed in the Z2 direction is schematically illustrated. In FIG. 6, two heads H included in the second head unit U2 are illustrated as a fifth head H_5 and a sixth head H_6.

As illustrated in FIG. 6, the second head unit U2 has a fourth section PA4, a fifth section PA5, a sixth section PA6, a fifth head H_5 and a sixth head H_6. The outline of the second head unit U2 as viewed in the Z2 direction is formed by the fourth section PA4, the fifth section PA5, and the sixth section PA6.

The fourth section PA4 is located between the fifth section PA5 and the sixth section PA6. Here, the positions of the fourth section PA4, the fifth section PA5, and the sixth section PA6 in the Y1 direction or the Y2 direction are different from each other. Specifically, the fifth section PA5 is located away from the fourth section PA4 in the Y2 direction, and the sixth section PA6 is located away from the fourth section PA4 in the Y1 direction. In other words, the fifth section PA5 projects in the Y2 direction from the end of the fourth section PA4 in the Y2 direction, and the sixth section PA6 projects in the Y1 direction from the end of the fourth section PA4 in the Y1 direction.

In addition, the fifth section PA5 is located away from center line CL2 in the X1 direction, and the sixth section PA6 is located away from center line CL2 in the X2 direction. In this manner, the fifth section PA5 and the sixth section PA6 are located on the opposite sides with respect to the center line CL2. Note that the center line CL2 is a virtual line segment which is parallel to the Y-axis and passes through the center of the fourth section PA4.

As illustrated in FIG. 6, width W5 of the fifth section PA5 along the X-axis is less than width W4 of the fourth section PA4 along the X-axis. Similarly, width W6 of the sixth section PA6 along the X-axis is less than the width W4 of the fourth section PA4 along the X-axis. In the example illustrated in FIG. 6, the width W5 and the width W6 are equal to each other. Note that the width W5 and the width W6 may be different from each other. However, when the width W5 and the width W6 are equal to each other, symmetry of the shape of the second head unit U2 is enhanced, thus the flexibility of arrangement of the second head unit U2 can be increased. Thus, this case has an advantage that the versatility of the second head unit U2 is increased.

Length L5 of the fifth section PA5 along the Y-axis is shorter than length L4 of the fourth section PA4 along the Y-axis. Similarly, length L6 of the sixth section PA6 along the Y-axis is shorter than length L4 of the fourth section PA4 along the Y-axis. In the example illustrated in FIG. 6, the length L5 and the length L6 are equal to each other. Note that the length L5 and the length L6 may be different from each other; however, when the length L5 and the length L6 are equal to each other, symmetry of the shape of the second head unit U2 can be enhanced, thus the flexibility of arrangement of the second head unit U2 can be increased.

Here, the number of the heads H included in the second head unit U2 is smaller than the number of the heads H included in the first head unit U1, thus the length L4 of the fourth section PA4 along the Y-axis is shorter than the length L1 of the first section PA1 of the first head unit U1 described above.

The positions of end E4*b* of the fourth section PA4 in the X1 direction and end E5 of the fifth section PA5 in the X1 direction are equal to each other in the X1 direction or the X2 direction. The end E4*b* and the end E5 form a continuous plane as an end face of the second head unit U2 in the X1 direction. Similarly, the positions of end E4*a* of the fourth section PA4 in the X2 direction and end E6 of the sixth section PA6 in the X2 direction are equal to each other in the X1 direction or the X2 direction. The end E4*a* and the end E6 form a continuous plane as an end face of the second head unit U2 in the X2 direction. Note that these end faces may be provided with recessed portions or projecting portions as needed. In addition, a step may be provided between the end E4*b* and the end E5 or between the end E4*a* and the end E6.

The fifth head H_5 is provided across the fourth section PA4 and the fifth section PA5. Specifically, the fifth head H_5 has a portion provided in the fourth section PA4 and a portion provided in the fifth section PA5, and these portions are continuously connected. The sixth head H_6 is provided across the fourth section PA4 and the sixth section PA6. Specifically, the sixth head H_6 has a portion provided in the fourth section PA4 and a portion provided in the sixth section PA6, and these portions are continuously connected.

In addition, the fifth head H_5 is located away from the sixth head H_6 in the Y2 direction. In other words, the sixth head H_6 is located away from the fifth head H_5 in the Y1 direction. In addition, the fifth head H_5 is located away from the sixth head H_6 in the X1 direction. In other words, the sixth head H_6 is located away from the fifth head H_5 in the X2 direction. In the example illustrated in FIG. 6, the fifth head H_5 and the sixth head H_6 are located on the opposite sides with respect to the center line CL2.

Here, the fifth head H_5 and the sixth head H_6 have portions overlapping each other cross-sectionally along the Y-axis by width WL4. Since such width WL4 is provided, a seam between images produced by the fifth head H_5 and the sixth head H_6 can be made less noticeable.

The width WL4 is less than each of the above-described width WL1, width WL2 and width WL3. In other words, each of the above-described width WL1, width WL2 and width WL3 is greater than the width WL4. Thus, the difference between the image quality produced by the first head H_1 and the image quality produced by the second head H_2 is easily reduced by correction. The width WL4 may be, for example, from 1/20 to 1/5 of each of the width WL1, the width WL2 and the width WL3. Specific width WL4 is not particularly limited, however, the width has a length from three times to 10 times the pitch between the nozzles N of the nozzle array La or the nozzle array Lb, for example.

Figure 7:
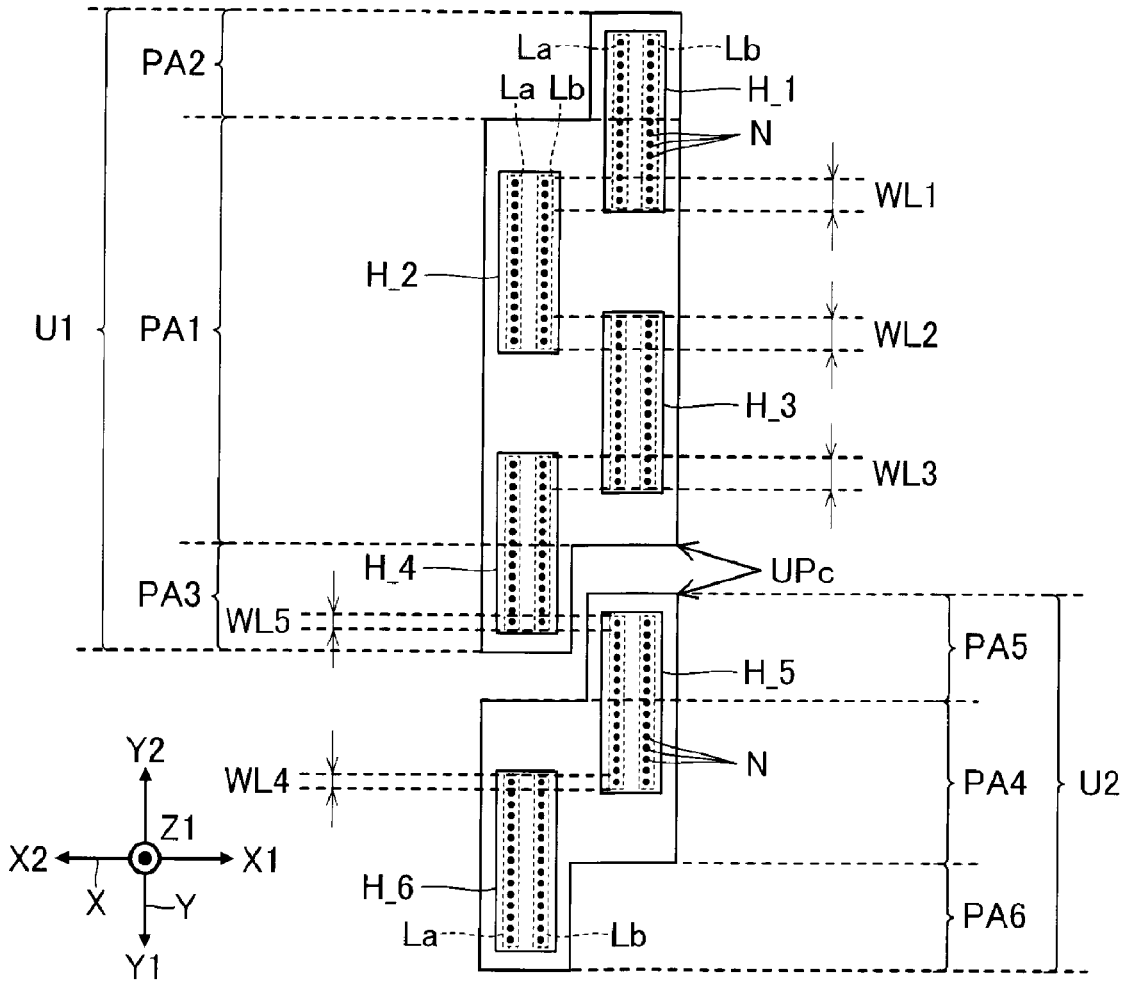
FIG. 7 is a view for explaining the arrangement of a plurality of head units in the first embodiment.

FIG. 7 is a view for explaining the arrangement of a plurality of head units H in the first embodiment. In FIG. 7, the arrangement of the first head unit U1 and the second head unit U2 as viewed in the Z2 direction is schematically illustrated. Similar to FIGS. 5 and 6 described above, FIG. 7 schematically illustrates the arrangement of the heads H as viewed in the Z2 direction.

As illustrated in FIG. 7, the first head unit U1 and the second head unit U2 are arranged along the Y-axis in a row so that the third section PA3 of the first head unit U1 and the fifth section PA5 of the second head unit U2 have portions overlapping each other cross-sectionally along the Y-axis.

Here, the fourth head H_4 and the fifth head H_5 have portions overlapping each other cross-sectionally along the Y-axis by width WL5. Since such width WL5 is provided, a seam between images produced by the fourth head H_4 and the fifth head H_5 can be made less noticeable.

The width WL5 is less than each of the above-described width WL1, width WL2 and width WL3. Therefore, the fourth head H_4 and the fifth head H_5 can be efficiently arranged. Note that the width WL5 may be equal to the width WL4, or may be larger than the width WL4, or may be less than the width WL4.

As described above, the liquid discharge apparatus 100 has a plurality of head units U that discharge ink which is an example of "liquid"; and a control unit 20 which is an example of a "controller" that controls the operation of discharge of ink in the plurality of head units U. The plurality of head units U include the first head unit U1, and second head unit U2 different from the first head unit U1.

As described above, the first head unit U1 has the first section PA1, the second section PA2, the third section PA3, the first head H_1, the second head H_2, the third head H_3 and the fourth head H_4. Here, the second section PA2 is at a position different from the position of the first section PA1 in the Y1 direction or the Y2 direction which is an example of "the first direction", and has the width W2 less than the width W1 of the first section PA1 in the X1 direction or the X2 direction which is an example of "the second direction" which intersects the Y1 direction or the Y2 direction. The third section PA3 is at a position different from the position of the first section PA1 in the Y1 direction or the Y2 direction, and has the width W3 less than the width W1 of the first section PA1 in the X1 direction or the X2 direction. A plurality of nozzles N are arranged in each of the first head H_1, the second head H_2, the third head H_3 and the fourth head H_4. The first head H_1 is provided across the first section PA1 and the second section PA2. Each of the second head H_2 and the third head H_3 is provided only in the first section PA1. The fourth head H_4 is provided across the first section PA1 and the third section PA3.

As described above, the second head unit U2 has the fourth section PA4, the fifth section PA5, the sixth section PA6, the fifth head H_5 and the sixth head H_6. Here, the fifth section PA5 is at a position different from the position of the fourth section PA4 in the Y1 direction or the Y2 direction, and has the width W5 less than the width W4 of the fourth section PA4 in the X1 direction or the X2 direction. The sixth section PA6 is at a position different from the position of the fourth section PA4 in the Y1 direction or the Y2 direction, and has a width less than the width W4 of the fourth section PA4 in the X1 direction or the X2 direction. A plurality of nozzles N are arranged in each of the fifth head H_5 and the sixth head H_6. The fifth head H_5 is provided across the fourth section PA4 and the fifth section PA5. The sixth head H_6 is provided across the fourth section PA4 and the sixth section PA6.

As described above, in the liquid discharge apparatus 100, even when a plurality of head units U including the first head unit U1 and the second head unit U2 with different numbers of heads H are used for various models, a desired print width can be achieved by changing each of the number of first head units U1 and the number of second head units U2 as needed. Therefore, the versatility of the head units U can be increased as compared with the related art in which a plurality of head units having the same configuration are solely used.

Based upon this, the width WL1 by which the first head H_1 and the second head H_2 overlap each other cross-sectionally along the Y1 direction or the Y2 direction is greater than the width WL4 by which the fifth head H_5 and the sixth head H_6 overlap each other cross-sectionally along the Y1 direction or the Y2 direction. Thus, the difference between the image quality produced by the first head H_1 and the image quality produced by the second head H_2 is easily reduced by correction. Thus, even when a deviation of characteristics of discharge occurs between the first head H_1 and the second head H_2, the difference between the image quality produced by the first head H_1 and the image quality produced by the second head H_2 can be reduced by correction. As a consequence, the image quality degradation due to the deviation can be reduced.

Here, the deviation of characteristics of discharge between the first head H_1 and the second head H_2 is caused by the temperature difference between the first head H_1 and the second head H_2. The temperature difference between the first head H_1 and the second head H_2 is greater than the temperature difference between the fifth head H_5 and the sixth head H_6. This occurs due to the following reasons (1) and (2).

Reason (1): in the first head unit U1, only the first section PA1 having a higher heat capacity than that of the second section PA2 is provided with the second head H_2, thus a temperature drop of the second head H_2 is unlikely to occur. However, in the second head H_2, not only the first section PA1 but also the second section PA2 is provided with the first head unit U1, thus a temperature drop of the first head H_1 is likely to occur. Therefore, the temperature difference between the first head H_1 and the second head H_2 is likely to occur. Since the width W2 of the second section PA2 is less than the width W1 of the first section PA1, the second section PA2 has a heat capacity lower than that of the first section PA1, thus is likely to release heat.

Reason (2): in the second head unit U2, a temperature drop of the fifth section PA5 is likely to occur because not only the fourth section PA4 but also the fifth section PA5 is provided with the fifth head H_5, and similarly, a temperature drop of the sixth head H_6 is likely to occur because not only the fourth section PA4 but also the sixth section PA6 is provided with the sixth head H_6. Therefore, the temperature difference between the fifth head H_5 and the sixth head H_6 is unlikely to occur.

Due to the reasons (1) and (2) stated above, a deviation of characteristics of discharge between the first head H_1 and the second head H_2 is likely to occur, whereas a deviation of characteristics of discharge between the fifth head H_5 and the sixth head H_6 is unlikely to occur. Thus, in order to reduce image quality degradation, correction is needed to reduce the difference between the image quality produced by the first head H_1 and the image quality produced by the second head H_2, whereas no correction is needed to reduce the difference between the image quality produced by the fifth head H_5 and the image quality produced by the sixth head H_6, or a lower degree of correction is needed as compared with correction to reduce the difference between the image quality produced by the first head H_1 and the image quality produced by the second head H_2. Therefore, the fifth head H_5 and the sixth head H_6 can be efficiently arranged by setting width WL4 to a value less than width WL1, the width WL4 by which the fifth head H_5 and the sixth head H_6 overlap each other cross-sectionally along the Y1 direction or the Y2 direction, the width WL1 by which the first head H_1 and the second head H_2 overlap each other cross-sectionally along the Y1 direction or the Y2 direction.

As described above, the width WL3 by which the third head H_3 and the fourth head H_4 overlap each other cross-sectionally along the Y1 direction or the Y2 direction is greater than the width WL4 by which the fifth head H_5 and the sixth head H_6 overlap each other cross-sectionally along the Y1 direction or the Y2 direction. Therefore, even when a deviation of characteristics of discharge between the third head H_3 and the fourth head H_4 occurs, the difference between the image quality produced by the third head H_3 and the image quality produced by the fourth head H_4 can be reduced by correction. As a consequence, the image quality degradation due to the deviation can be reduced. Similar to the temperature difference between the first head H_1 and the second head H_2, the temperature difference between the third head H_3 and the fourth head H_4 is likely to occur.

As described above, the width WL2 by which the second head H_2 and the third head H_3 overlap each other cross-sectionally along the Y1 direction or the Y2 direction is greater than the width WL4 by which the fifth head H_5 and the sixth head H_6 overlap each other cross-sectionally along the Y1 direction or the Y2 direction. Therefore, the width WL2 by which the second head H_2 and the third head H_3 overlap each other cross-sectionally along the Y1 direction or the Y2 direction can be made equal to the width WL1 by which the first head H_1 and the second head H_2 overlap each other cross-sectionally along the Y1 direction or the Y2 direction.

In the present embodiment, the width WL1 by which the first head H_1 and the second head H_2 overlap each other cross-sectionally along the Y1 direction or the Y2 direction is equal to the width WL2 by which the second head H_2 and the third head H_3 overlap each other cross-sectionally along the Y1 direction or the Y2 direction. Therefore, as compared with the configuration in which these widths are different, the design of the first head unit U1 can be simplified. Note that in the present specification, "equal" refers to not only "strictly equal", but also "nearly equal with a slight difference due to a manufacturing error".

As described above, two adjacent head units U among the plurality of head units U included in the liquid discharge apparatus 100 are arranged in a row in the Y1 direction or the Y2 direction so as to have portions overlapping each other cross-sectionally along the Y1 direction or the Y2 direction. Here, the first head unit U1 and the second head unit U2 are arranged in a row in the Y1 direction or the Y2 direction so as to have portions overlapping each other cross-sectionally along the Y1 direction or the Y2 direction. Therefore, portions of the fourth head H_4 and the fifth head H_5 can be overlapped with each other cross-sectionally along the Y1 direction or the Y2 direction.

In addition, as described above, a plurality of head units U included in the liquid discharge apparatus 100 are arranged at the same position in the X1 direction or the X2 direction. Here, the first head unit U1 and the second head unit U2 are arranged at the same position in the X1 direction or the X2 direction. Consequently, the efficiency of arrangement of these head units U in the X1 direction or the X2 direction can be increased, as compared with a configuration in which the positions of the first head unit U1 and the second head unit U2 in the X1 direction or the X2 direction are different from each other.

As described above, the width WL5 by which the fourth head H_4 and the fifth head H_5 overlap each other cross-sectionally along the Y1 direction or the Y2 direction is less than the width WL1 by which the first head H_1 and the second head H_2 overlap each other cross-sectionally along the Y1 direction or the Y2 direction. A temperature drop of the fourth head H_4 is likely to occur because not only the first section PA1 but also the third section PA3 is provided with the fourth head H_4, and similarly, a temperature drop of the fifth head H_5 is likely to occur because not only the fourth section PA4 but also the fifth section PA5 is provided with the fifth head H_5. Thus, in order to reduce image quality degradation, no correction is needed to reduce the difference between the image quality produced by the fourth head H_4 and the image quality produced by the fifth head H_5, or a lower degree of correction is needed as compared with correction to reduce the difference between the image quality produced by the first head H_1 and the image quality produced by the second head H_2. Therefore, the fourth head H_4 and the fifth head H_5 can be efficiently arranged by setting width WL5 to a value less than width WL1, the width WL5 by which the fourth head H_4 and the fifth head H_5 overlap each other cross-sectionally along the Y1 direction or the Y2 direction, the width WL1 by which the first head H_1 and the second head H_2 overlap each other cross-sectionally along the Y1 direction or the Y2 direction.

Here, the width WL5 by which the fourth head H_4 and the fifth head H_5 overlap each other cross-sectionally along the Y1 direction or the Y2 direction may be greater than the width WL4 by which the fifth head H_5 and the sixth head H_6 overlap each other cross-sectionally along the Y1 direction or the Y2 direction. In this setting, the fourth head H_4 and the fifth head H_5 can be arranged by allowing an installation error for the first head unit U1 and the second head unit U2.

However, the width WL5 by which the fourth head H_4 and the fifth head H_5 overlap each other cross-sectionally along the Y1 direction or the Y2 direction may be less than the width WL4 by which the fifth head H_5 and the sixth head H_6 overlap each other cross-sectionally along the Y1 direction or the Y2 direction. In this setting, there is an advantage that another member is easily arranged between the first head unit U1 and the second head unit U2. For example, the temperature difference between the first head unit U1 and the second head unit U2 can be reduced by using a member having a superior heat conductivity as another member. Another member is not particularly limited, but may be, for example, a spacer made of metal, or an adhesive agent containing metal powder or ceramic powder.

As described above, the length L1 of the first section PA1 in the Y1 direction or the Y2 direction is longer than the length L4 of the fourth section PA4 in the Y1 direction or the Y2 direction. When the length L1 and the length L4 have such a magnitude relation, the heat capacity of the first section PA1 is higher than the heat capacity of the fourth section PA4. Therefore, the temperature difference between the first head H_1 and the second head H_2 is likely to be greater than the temperature difference between the fifth head H_5 and the sixth head H_6.

As described above, the liquid discharge apparatus 100 has a plurality of head units U arranged in a row in the Y1 direction or the Y2 direction. The plurality of head units U include one or more first head units U1, and one or more second head units U2 different from any of the one or more first head units U1. Here, the arrangement and the number of the first head units U1 and the second head units U2 satisfy $a \geq b \geq 0$, $p \geq 1$, $q \geq 1$. In the present embodiment, a, b, p and q are given by a=0, b=0, p=1, q=1.

Where a is the number of pairs each consisting of two adjacent first head units U1 among one or more first head units U1 included in the liquid discharge apparatus 100, b is the number of pairs each consisting of two adjacent second head units U2 among one or more second head units U2 included in the liquid discharge apparatus 100, p is the number of the first head units U1 in one or more first head units U1 included in the liquid discharge apparatus 100, and q is the number of the second head units U2 in one or more second head units U2 included in the liquid discharge apparatus 100.

Thus, the temperature difference between whole heads H in a plurality of head units U included in the liquid discharge apparatus 100 can be reduced by satisfying $a \geq b \geq 0$, $p \geq 1$, $q \geq 1$, as compared with a configuration in which this relationship is not satisfied. Thus, it is possible to reduce a deviation of characteristics of discharge due to the temperature difference between whole heads H in the plurality of head units U. As a consequence, the image quality degradation due to the deviation can be reduced.

Specifically, the plurality of head units U included in the liquid discharge apparatus 100 include one or more first head units U1, thus $p \geq 1$. The plurality of head units U included in the liquid discharge apparatus 100 include one or more second head units U2, thus $q \geq 1$.

In the first head unit U1, the heat capacity of each of the second section PA2 and the third section PA3 is lower than the heat capacity of the first section PA1, thus a temperature drop in the second section PA2 and the third section PA3 is more likely to occur than in the first section PA1. Similarly, in the second head unit U2, the heat capacity of each of the fifth section PA5 and the sixth section PA6 is lower than the heat capacity of the fourth section PA4, thus a temperature drop in the fifth section PA5 and the sixth section PA6 is more likely to occur than in the fourth section PA4.

Here, the number of heads H provided in the first head unit U1 is larger than the number of heads H provided in the second head unit U2, and accordingly, the volume of the first section PA1 of the first head unit U1 is greater than the volume of the fourth section PA4 of the second head unit U2. Therefore, the heat capacity of the first section PA1 of the first head unit U1 is higher than the heat capacity of the fourth section PA4 of the second head unit U2. In other words, the heat capacity of the fourth section PA4 of the second head unit U2 is lower than the heat capacity of the first section PA1 of the first head unit U1. As a consequence, a temperature drop in each of the fifth section PA5 and the sixth section PA6 of the second head unit U2 is more likely to occur than in each of the second section PA2 and the third section PA3 of the first head unit U1. Furthermore, when second head units U2 are arranged adjacent to each other, a temperature drop in each of the fifth section PA5 and the sixth section PA6 of the second head unit U2 is further noticeable, as compared with a configuration in which second head units U2 are not adjacent to each other.

Therefore, from the point of view of reducing the temperature difference between whole heads H in a plurality of head units U included in the liquid discharge apparatus 100, the number b of pairs UPb each consisting of two adjacent second head units U2 may be as small as possible.

Thus, the liquid discharge apparatus 100 satisfies $a \geq b \geq 0$. A temperature drop in each of the fifth section PA5 and the sixth section PA6 of the second head unit U2 can be reduced by satisfying the above relationship. Thus, it is possible to reduce the difference between the temperature of the head H provided in the first head unit U1 and the temperature of the head H provided in the second head unit U2. As a consequence, the temperature difference between whole heads H in a plurality of head units U included in the liquid discharge apparatus 100 can be reduced.

As described above, c=1 where c is the number of pairs UPc each consisting of adjacent first head unit U1 and second head unit U2 among the one or more first head units U1 and the one or more second head units U2. With c=1, when only two types, that is, the first head unit U1 and the second head unit U2 are used, the number of second head units U2 is one, thus there is an advantage that it is easy to reduce the temperature difference between whole heads H in a plurality of head units U included in the liquid discharge apparatus 100.

In the present embodiment, as described above, b=0. With b=0, temperature drop of each of the fifth section PA5 and the sixth section PA6 of the second head unit U2 can be advantageously reduced because second head units U2 are not adjacent to each other.

In the present embodiment, as described above, a>b. With a>b, temperature drop of each of the fifth section PA5 and the sixth section PA6 of the second head unit U2 can be advantageously reduced, as compared with a configuration in which a=b.

In the present embodiment, as described above, p≥q. With p≥q, even when only two types, that is, the first head unit U1 and the second head unit U2 are used, there is an advantage that it is easy to satisfy a≥b.

As described above, when one side of the Y1 direction or the Y2 direction is referred to as a first side, the second section PA2 is coupled to the end, on the first side, of the first section PA1. When the other side of the Y1 direction or the Y2 direction is referred to as a second side, the third section PA3 is coupled to the end, on the second side, of the first section PA1. When one side of the X1 direction or the X2 direction is referred to as a third side, end E2, on the third side, of the second section PA2, and end E1*b*, on the third side, of the first section PA1 are at the same position in the X1 direction or the X2 direction. When the other side of the X1 direction or the X2 direction is referred to as a fourth side, end E3, on the fourth side, of the third section PA3, and end E1*a*, on the fourth side, of the first section PA1 are at the same position in the X1 direction or the X2 direction.

As described above, when one side of the Y1 direction or the Y2 direction is referred to as the first side, the fifth section PA5 is coupled to the end, on the first side, of the fourth section PA4. When the other side of the Y1 direction or the Y2 direction is referred to as the second side, the sixth section PA6 is coupled to the end, on the second side, of the fourth section PA4. When one side of the X1 direction or the X2 direction is referred to as the third side, end E5, on the third side, of the fifth section PA5, and end E4*b*, on the third side, of the fourth section PA4 are at the same position in the X1 direction or the X2 direction. When the other side of the X1 direction or the X2 direction is referred to as the fourth side, end E6, on the fourth side, of the sixth section PA6, and end E4*a*, on the fourth side, of the fourth section PA4 are at the same position in the X1 direction or the X2 direction.

As described above, length LA1 of the first head unit U1 in the Y1 direction or the Y2 direction is longer than length LA2 of the second head unit U2 in the Y1 direction or the Y2 direction. In this setting, length L1 of the first section PA1 in the Y1 direction or the Y2 direction is longer than length L4 of the fourth section PA4 in the Y1 direction or the Y2 direction. Heads H having the same configuration can be used for the first head unit U1 and the second head unit U2 with different number of heads H mounted.

The first head H_1, the second head H_2, the third head H_3, the fourth head H_4, the fifth head H_5 and the sixth head H_6 may discharge the same type of ink, or may discharge different types of ink. When these heads H discharge ink of the same color, there is an advantage that the difference between image qualities produced by these heads H is easily reduced by correction.

When different types of ink are used for two or more heads H among these heads H, each of the first head H_1, the second head H_2, the third head H_3 and the fourth head H_4 may discharge at least one of cyan ink, magenta ink, yellow ink and black ink. In this setting, as compared with the second head unit U2, the print width set by the first head unit U1 is greater, thus there is an advantage that the image quality is easily improved. Here, the ink used for the second head unit U2 may be the same as the ink used for the first head unit U1; however, when liquid containing no color material, such as clear ink, white ink or treatment liquid, is used, each of the fifth head H_5 and the sixth head H_6 may discharge at least one of clear ink, white ink and treatment liquid. This is because as compared with discharge of ink containing a color material, high characteristics of discharge are not needed for discharge of clear ink, white ink and treatment liquid.

As described above, the liquid discharge apparatus 100 of the present embodiment has the movement mechanism 40 and the transport mechanism 30. The movement mechanism 40 moves a plurality of head units U along the X1 direction or the X2 direction. The transport mechanism 30 transports a medium M along the Y1 direction or the Y2 direction, the medium M being an example of a "recording medium". The liquid discharge apparatus 100 in serial system can be implemented in a desirable mode by using such movement mechanism 40 and transport mechanism 30.

2. Second Embodiment

Hereinafter a second embodiment of the present disclosure will be described. In the embodiments illustrated below, any component having the same operation and function as in the first embodiment is labeled with the symbol used in the description of the first embodiment, and a detailed description of the component is omitted as appropriate.

Figure 8:
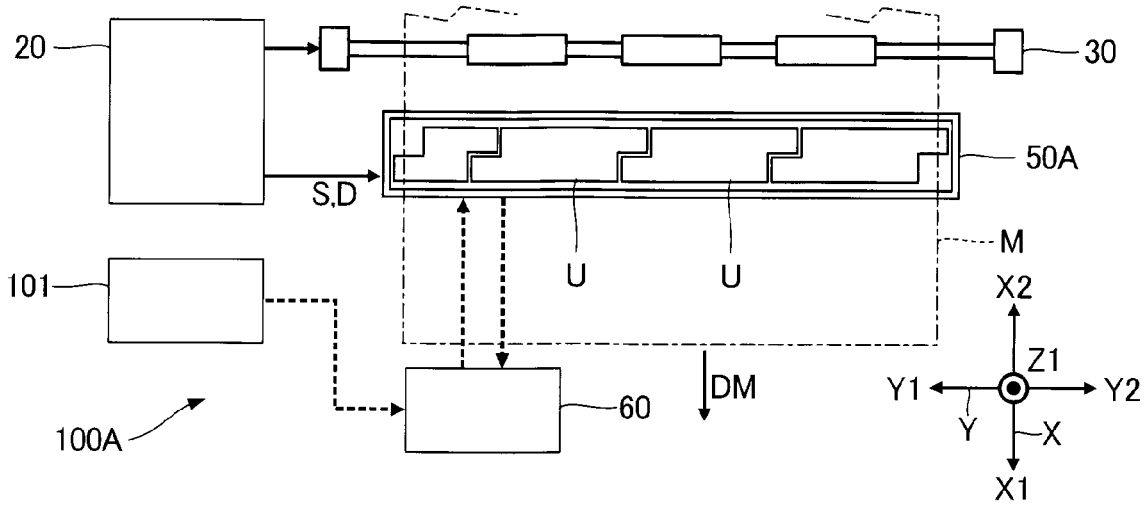
FIG. 8 is a schematic view illustrating a configuration example of a liquid discharge apparatus according to a second embodiment.

FIG. 8 is a schematic view illustrating a configuration example of a liquid discharge apparatus 100A according to a second embodiment. The liquid discharge apparatus 100A is a printing apparatus in line system, and is the same as the above-described liquid discharge apparatus 100 of the first embodiment except that head module 50A is included instead of the movement mechanism 40 and the head module 50. However, in the present embodiment, the transport direction DM of the medium M transported by the transport mechanism 30 is the X1 direction.

The head module 50A is a line head having a plurality of head units U in which a plurality of nozzles are arranged to be distributed over the entire range of the medium M along the Y-axis. Ink is discharged from the plurality of head units U of the head module 50A concurrently with transport of the medium M by the transport mechanism 30, thus an image of the ink is formed on the surface of the medium M.

Figure 9:
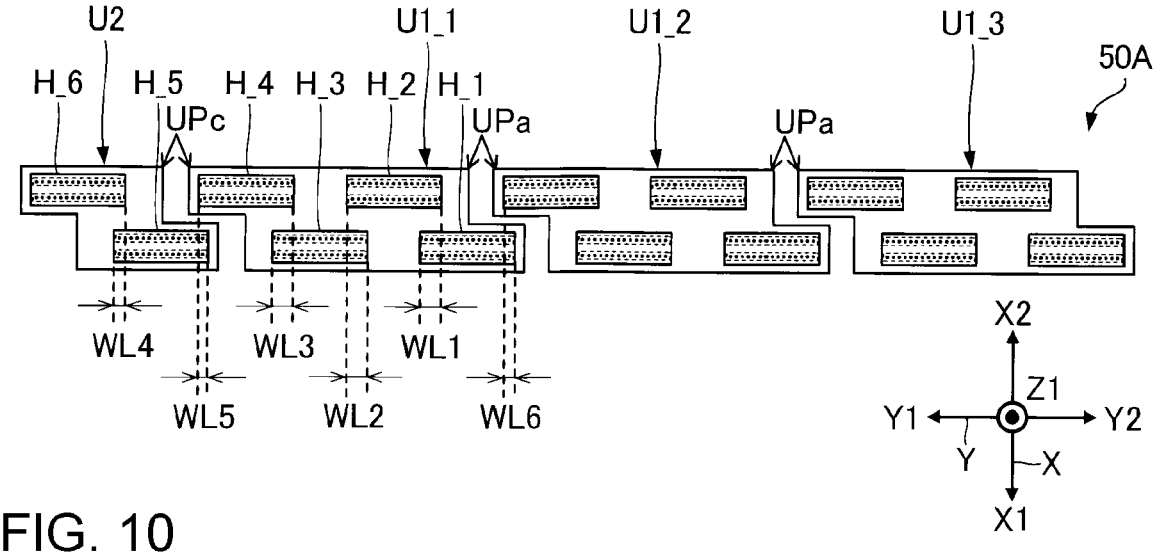
FIG. 9 is a view for explaining the arrangement of a plurality of head units in the second embodiment.

FIG. 9 is a view for explaining the arrangement of a plurality of head units U in the second embodiment. The head module 50A has three first head units U1_1 to U1_3, and three second head units U2 as a plurality of head units U. Each of the first head units U1_1 to U1_3 is formed in the same manner as the first head unit U1 of the above-described first embodiment is formed.

As illustrated in FIG. 9, in the head module 50A, the second head unit U2, the first head unit U1_1, the first head unit U1_2, and the first head unit U1_3 are arranged in this order in a row in the Y2 direction. In the head module 50A, similar to in the first embodiment, the number of pairs UPc is one, however, the number of pairs UPa each consisting of two adjacent first head units U1 among one or more first head units U1 included in the liquid discharge apparatus 100A is two. In the present embodiment, a, b, p and q mentioned above are given by a=2, b=0, p=3, q=1 which satisfy a≥b≥0, p≥1, q≥1. In addition, c=1 in the present embodiment.

Similar to the first head unit U1 and the second head unit U2 of the above-described first embodiment, the fourth head H_4 of the first head unit U1_1 and the fifth head H_5 of the second head unit U2 have portions overlapping each other cross-sectionally along the Y direction by the width WL5. In addition, the first head H_1 of the first head unit U1_1 and the fourth head H_4 of the first head unit U1_2 have portions overlapping each other cross-sectionally along the Y-axis by width WL6. Since such width WL6 is provided, a seam between images produced by the first head unit U1_1 and the first head unit U1_2 can be made less noticeable.

The width WL6 is not particularly limited, but may be approximately equal to the width WL1, the width WL2 or the width WL3 mentioned above, or approximately equal to the width WL5 mentioned above. In this setting, heads H related to the width WL6 just need to be controlled by a method similar to the control performed on a cross-sectionally overlapping portion between other heads H, and there is an advantage that the control is easily performed.

The width by which the first head unit U1_2 and the first head unit U1_3 overlap cross-sectionally along the Y-axis may be different from the width by which the first head unit U1_1 and the first head unit U1_2 overlap cross-sectionally along the Y-axis, but may be approximately equal to the width by which the first head unit U1_1 and the first head unit U1_2 overlap cross-sectionally along the Y-axis.

Similar to the above-described first embodiment, the second embodiment described above enables the versatility of the head unit U to be increased as compared with the related art. In the present embodiment, as described above, p>q. With p>q, even when only two types, the first head unit U1 and the second head unit U2 are used, there is an advantage that a>b is likely to be satisfied.

As described above, the liquid discharge apparatus 100A of the present embodiment has the transport mechanism 30 that transports the medium M along the X1 direction or the X2 direction. Thus, the liquid discharge apparatus 100A in line system can be implemented in a desirable mode by arranging a plurality of head units U including the first head unit U1 and the second head unit U2 in a direction crossing the transport direction DM of the medium M transported by the transport mechanism 30.

5. Modifications

The embodiments illustrated above can be modified in various manners. Specific aspects of modification applicable to the above-described embodiments will be illustrated below. Two or more aspects arbitrarily selected from the examples below may be combined as appropriate in a range where the aspects do not contradict each other.

5-1. Modification 1

Figure 10:
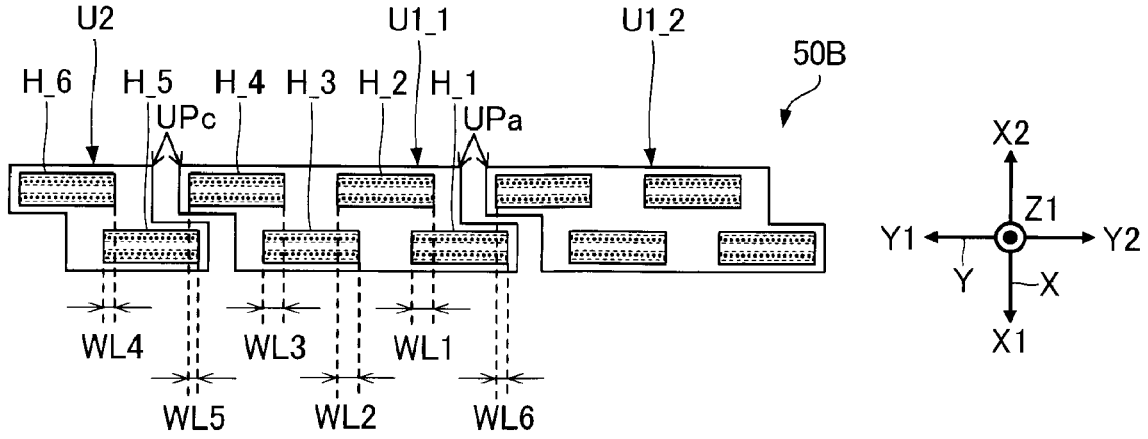
FIG. 10 is a view for explaining the arrangement of a plurality of head units in Modification 1.

FIG. 10 is a view for explaining the arrangement of a plurality of head units U in Modification 1. Head module 50B illustrated in FIG. 10 is the same as the head module 50A of the second embodiment described above except that the first head unit U1_3 is omitted. In Modification 1, a, b, p and q mentioned above are given by a=1, b=0, p=2, q=1 which satisfy a≥b≥0, p≥1, q≥1. In Modification 1, c=1. Similar to the above-described embodiment, Modification 1 above enables the versatility of the head unit U to be increased as compared with the related art.

5-2. Modification 2

Figure 11:
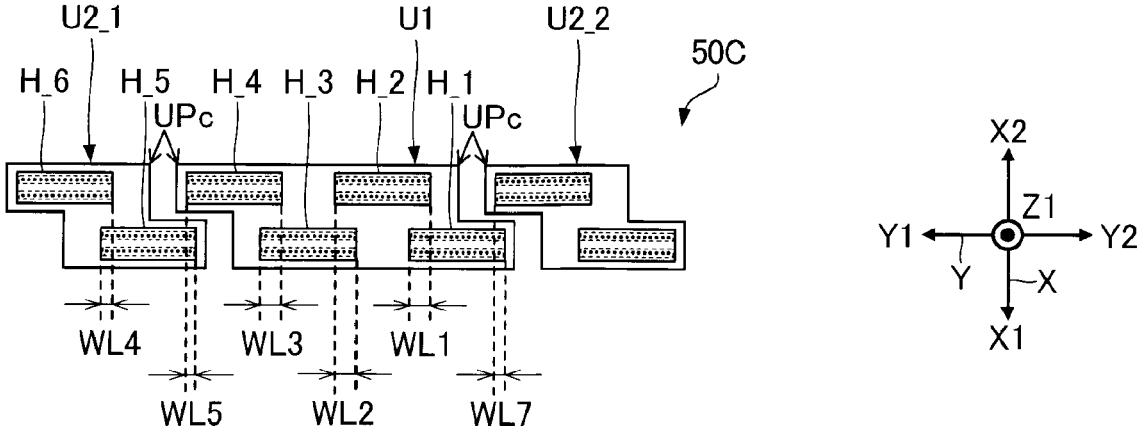
FIG. 11 is a view for explaining the arrangement of a plurality of head units in Modification 2.

FIG. 11 is a view for explaining the arrangement of a plurality of head units U in Modification 2. In head module 50C illustrated in FIG. 11, the second head unit U2_1, the first head unit U1, and the second head unit U2_2 are arranged in this order in a row in the Y2 direction. In Modification 2, a, b, p and q mentioned above are given by a=0, b=0, p=1, q=2 which satisfy a≥b≥0, p≥1, q≥1. In Modification 2, c=2.

Similar to the first head unit U1 and the second head unit U2 of the above-described first embodiment, the fourth head H_4 of the first head unit U1 and the fifth head H_5 of the second head unit U2_1 have portions overlapping each other cross-sectionally along the Y-axis by the width WL5. In addition, the first head H_1 of the first head unit U1 and the sixth head H_6 of the second head unit U2_2 have portions overlapping each other cross-sectionally along the Y-axis by width WL7.

The width WL7 is not particularly limited, however, may be approximately equal to the width WL5 mentioned above. In this setting, heads H related to the width WL7 just need to be controlled by a method similar to the control performed on a cross-sectionally overlapping portion between heads H related to the width WL5, and there is an advantage that the control is easily performed.

Similar to the above-described embodiment, Modification 2 above enables the versatility of the head unit U to be increased as compared with the related art.

5-3. Modification 3

Figure 12:
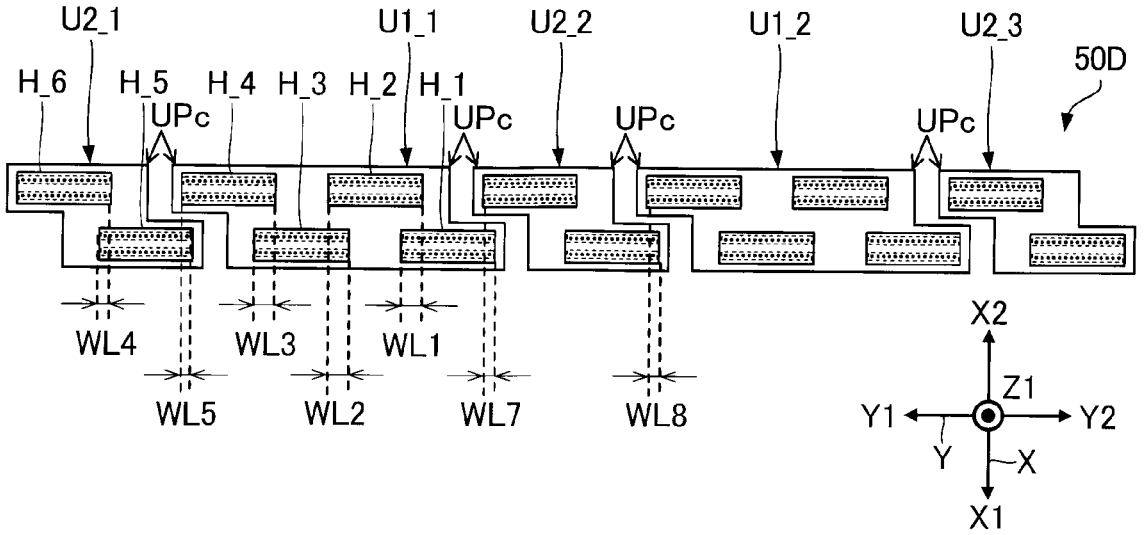
FIG. 12 is a view for explaining the arrangement of a plurality of head units in Modification 3.

FIG. 12 is a view for explaining the arrangement of a plurality of head units U in Modification 3. In head module 50D illustrated in FIG. 12, the second head unit U2_1, the first head unit U1_1, the second head unit U2_2, the first head unit U1_2, and the second head unit U2_3 are arranged in this order in a row in the Y2 direction. In Modification 3, a, b, p and q mentioned above are given by a=0, b=0, p=2, q=3 which satisfy a≥b≥0, p≥1, q≥1. In Modification 3, c=4.

Similar to the first head unit U1 and the second head unit U2 of the above-described first embodiment, the fourth head H_4 of the first head unit U1_1 and the fifth head H_5 of the second head unit U2_1 have portions overlapping each other cross-sectionally along the Y-axis by the width WL5. In addition, the first head H_1 of the first head unit U1_1 and the sixth head H_6 of the second head unit U2_2 have portions overlapping each other cross-sectionally along the Y-axis by the width WL7. The fourth head H_4 of the first head unit U1_2 and the fifth head H_5 of the second head unit U2_2 have portions overlapping each other cross-sectionally along the Y-axis by width WL8.

The width WL8 is not particularly limited, however, may be approximately equal to the width WL5 mentioned above. In this setting, heads H related to the width WL8 just need to be controlled by a method similar to the control performed on a cross-sectionally overlapping portion between heads H related to the width WL5, and there is an advantage that the control is easily performed.

Similar to the above-described embodiment, Modification 3 above enables the versatility of the head unit U to be increased as compared with the related art.

5-4. Modification 4

Figure 13:
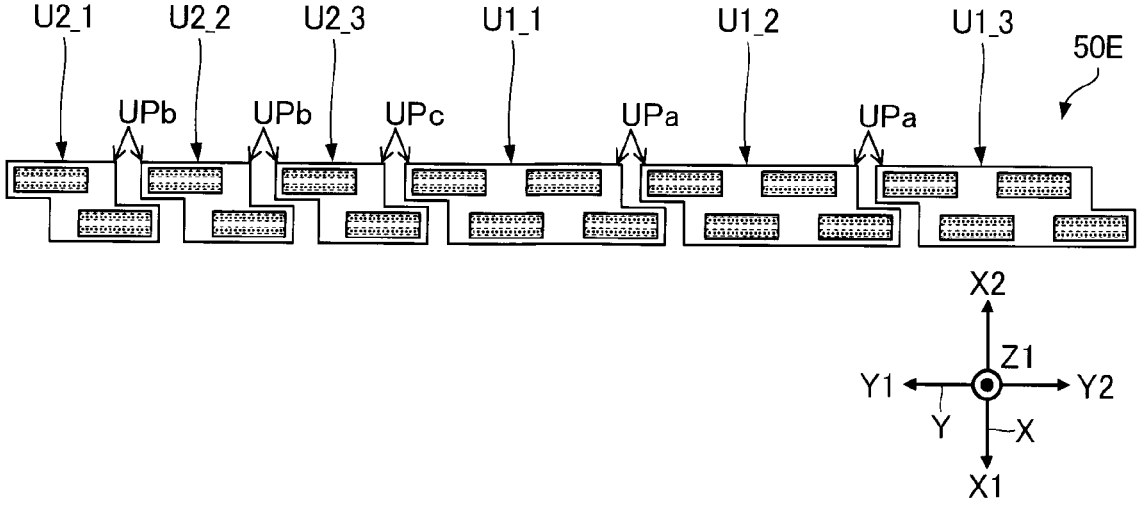
FIG. 13 is a view for explaining the arrangement of a plurality of head units in Modification 4.

FIG. 13 is a view for explaining the arrangement of a plurality of head units U in Modification 4. In head module 50E illustrated in FIG. 13, the second head unit U2_1, the second head unit U2_2, the second head unit U2_3, the first head unit U1_1, the first head unit U1_2, and the first head unit U1_3 are arranged in this order in a row in the Y2 direction. The number of pairs UPb each consisting of two adjacent second head units U2 among one or more second head units U2 included in the head module 50E is two. In Modification 4, a, b, p and q mentioned above are given by a=2, b=2, p=3, q=3 which satisfy a≥b≥0, p≥1, q≥1. In Modification 4, c=1.

Here, the overlapping width along the Y-axis of heads H of the adjacent first head unit U1 and second head unit U2 is the same as the width WL5 mentioned above. Also, the overlapping width along the Y-axis of heads H of two adjacent first head units U1 is the same as the width WL6 mentioned above. The overlapping width along the Y-axis of heads H of two adjacent second head units U2 is not particularly limited, however, is in a range from the width WL5 to the width WL6.

Similar to the above-described embodiment, Modification 4 above enables the versatility of the head unit U to be increased as compared with the related art.

5-5. Modification 5

The number of head units U included in the liquid discharge apparatus is not limited to the embodiment described above. For example, in the first embodiment, four sets each consisting of the first head unit U1 and the second head unit U2 are provided. The number of the sets may be one or more and three or less, or five or more. As described above, the number of head units U in a row in the Y1 direction or the Y2 direction is not limited to the number illustrated, and could be any number as long as $a \geq b \geq 0$, $p \geq 1$, $q \geq 1$.

5-6. Modification 6

The plurality of head units U included in the liquid discharge apparatus may include a head unit U having a configuration different from the configuration of the first head unit U1 and the second head unit U2.

5-7. Modification 7

In the above-described embodiment, the circulation mechanism 60 is provided externally of the head unit U, and a configuration is illustrated in which ink is circulated between the head unit U and the circulation mechanism 60. However, it is sufficient that ink be circulated between the head unit U and an external unit without using the circulation mechanism 60. For example, ink may be circulated between the head unit U and the liquid container 101.

5-8. Modification 8

The liquid discharge apparatus illustrated in the above-described embodiment may be used for various devices, such as a facsimile machine and a copying machine, in addition to machines specifically for printing. However, application of the liquid discharge apparatus is not limited to printing. For example, the liquid discharge apparatus that discharges a solution of a color material is utilized as a manufacturing apparatus that forms a color filter for a display device such as a liquid crystal display panel. In addition, the liquid discharge apparatus that discharges a solution of a conductive material is utilized as a manufacturing apparatus that forms wires of a wiring substrate and an electrode. In addition, the liquid discharge apparatus that discharges a solution of organic substances related to a living body is utilized as a manufacturing apparatus that manufactures biochips, for example.

What is claimed is:

1. A liquid discharge apparatus comprising:

a plurality of head units that are arranged in a row in a first direction and that discharge liquid; and a controller that controls an operation of discharge of liquid in the plurality of head units, wherein the plurality of head units includes:

one or more first head units and one or more second head units different from any the one or more first head units, each of the one or more first head units including:

a first section, a second section that is at a position different from a position of the first section in a first direction and that has a width less than a width of the first section in a second direction crossing the first direction, a third section that is at a position different from the position of the first section in the first direction and that has a width less than the width of the first section in the second direction, a first head which is provided across the first section and the second section and in which a plurality of nozzles are arranged, a second head which is provided only in the first section and in which a plurality of nozzles are arranged, a third head which is provided only in the first section and in which a plurality of nozzles are arranged, and a fourth head which is provided across the first section and the third section and in which a plurality of nozzles are arranged, each of the one or more second head units including:

a fourth section, a fifth section that is at a position different from a position of the fourth section in the first direction and that has a width less than a width of the fourth section in the second direction, a sixth section that is at a position different from the position of the fourth section in the first direction and the has a width less than the width of the fourth section in the second direction, a fifth head which is provided across the fourth section and the fifth section and in which a plurality of nozzles are arranged, and a sixth head which is provided across the fourth section and the sixth section and in which a plurality of nozzles are arranged, wherein $a \geq b \geq 0$, $p \geq 1$, $q \geq 1$, where a is a number of pairs each consisting of two adjacent first head units among the one or more first head units, b is a number of pairs each consisting of two adjacent second head units among the one or more second head units, p is a number of first head units in the one or more first head units, and q is a number of second head units in the one or more second head units.

2. The liquid discharge apparatus according to claim 1, wherein $c=1$, where c is a number of pairs each consisting of adjacent first head unit and second head unit among the one or more first head units and the one or more second head units.

3. The liquid discharge apparatus according to claim 1, wherein $b=0$.

4. The liquid discharge apparatus according to claim 1, wherein $a>b$.

5. The liquid discharge apparatus according to claim 1, wherein $p \geq q$.

6. The liquid discharge apparatus according to claim 5, wherein $p>q$.

7. The liquid discharge apparatus according to claim 1, wherein two adjacent head units among the plurality of head units are arranged in a row along the first direction so as to have portions overlapping each other cross-sectionally along the first direction.

8. The liquid discharge apparatus according to claim 7, wherein the plurality of head units are arranged at positions which are equal to each other in the second direction.

9. The liquid discharge apparatus according to claim 1, wherein a length of the first section in the first direction is longer than a length of the fourth section in the first direction.

10. The liquid discharge apparatus according to claim 1, wherein let one side of the first direction be a first side, let the other side of the first direction be a second side, let one side of the second direction be a third side, let the other side of the second direction be a fourth side, the second section is coupled to an end, on the first side, of the first section, the third section is coupled to an end, on the second side, of the first section, an end, on the third side, of the second section, and an end, on the third side, of the first section are at positions which are equal in the second direction, and an end, on the fourth side, of the third section, and an end, on the fourth side, of the first section are at positions which are equal in the second direction.

11. The liquid discharge apparatus according to claim 1, wherein let one side of the first direction be a first side, let the other side of the first direction be a second side, let one side of the second direction be a third side, let the other side of the second direction be a fourth side, the fifth section is coupled to an end, on the first side, of the fourth section, the sixth section is coupled to an end, on the second side, of the fourth section, an end, on the third side, of the fifth section, and an end, on the third side, of the fourth section are at positions which are equal in the second direction, and an end, on the fourth side, of the sixth section, and an end, on the fourth side, of the fourth section are at positions which are equal in the second direction.

12. The liquid discharge apparatus according to claim 1, wherein a length of the first head unit in the first direction is longer than a length of the second head unit in the first direction.

13. The liquid discharge apparatus according to claim 1, wherein the first head, the second head, the third head, the fourth head, the fifth head and the sixth head discharge ink of same color.

14. The liquid discharge apparatus according to claim 1, wherein each of the first head, the second head, the third head and the fourth head discharges at least one of cyan ink, magenta ink, yellow ink and the black ink, and each of the fifth head and the sixth head discharges at least one of clear ink, white ink and treatment liquid.

15. The liquid discharge apparatus according to claim 1, further comprising a transport mechanism that transports a recording medium along the second direction.

16. The liquid discharge apparatus according to claim 1, further comprising:

a movement mechanism that moves the plurality of head units along the second direction; and a transport mechanism that transports a recording medium along the first direction.

* * * * *